US006369015B1

(12) United States Patent
Groot et al.

(10) Patent No.: US 6,369,015 B1
(45) Date of Patent: Apr. 9, 2002

(54) PARTICULATE LAUNDRY DETERGENT COMPOSITIONS CONTAINING ANIONIC SURFACTANT GRANULES

(75) Inventors: Andreas Theodorus Johannes Groot; Marco Klaver, both of Vaardingenl (NL)

(73) Assignee: Unilever Home & Personal Care, USA division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/442,509

(22) Filed: Nov. 18, 1999

(30) Foreign Application Priority Data

Nov. 20, 1998 (GB) ..... 9825563

(51) Int. Cl.[7] ..... C11D 17/00

(52) U.S. Cl. ..... 510/352; 510/377; 510/446; 510/421; 510/424; 510/427; 510/507; 510/509

(58) Field of Search ..... 510/349, 351, 510/352, 377, 446, 421, 422, 424, 427, 507, 509

(56) References Cited

U.S. PATENT DOCUMENTS

| | | | |
|---|---|---|---|
| 3,920,586 A | 11/1975 | Bonaparte et al. | 252/531 |
| 5,516,447 A | 5/1996 | Bauer et al. | 252/89.1 |

FOREIGN PATENT DOCUMENTS

| | | | |
|---|---|---|---|
| DE | 42 16629 A1 | | 11/1993 |
| DE | 42 16 775 | | 11/1993 |
| DE | 42 29 660 | | 3/1994 |
| DE | 195 24 722 | | 1/1997 |
| EP | 555 622 A | | 8/1993 |
| EP | 0643130 | * | 4/1994 |
| EP | 0 688 861 | | 12/1995 |
| GB | 2 221 695 | | 2/1990 |
| WO | 92/06170 | | 4/1992 |
| WO | 93/02168 | | 2/1993 |
| WO | 94/07990 | | 4/1994 |
| WO | 95/02036 | | 1/1995 |
| WO | 96/04359 A | | 2/1996 |
| WO | 96/06916 A | | 3/1996 |
| WO | 96/06917 A | | 3/1996 |
| WO | 97/32002 | | 9/1997 |
| WO | 97/32005 | | 9/1997 |
| WO | 97/33957 | | 9/1997 |
| WO | 98/54278 | | 12/1998 |
| WO | 98/54281 | | 12/1998 |
| WO | 98/54286 | | 12/1998 |
| WO | 98/54287 | | 12/1998 |
| WO | 98/54289 | | 12/1998 |

OTHER PUBLICATIONS

PCT International Search Report PCT/EP 99/08895.
PCT International Search Report PCT/EP 99/08896.

* cited by examiner

*Primary Examiner*—Necholus Ogden
(74) *Attorney, Agent, or Firm*—Rimma Mitelman

(57) ABSTRACT

A particulate laundry detergent is composed of at least two different granular components, one of which is an anionic surfactant granule having a bulk density of 300–600 g/l comprising linear alkylbenzene sulphonate on a particulate carrier material comprising of sodium carbonate and an optional finely-divided water-insoluble particulate material, preferably zeolite, which must be present if the average particle size of the sodium carbonate exceeds 40 $\mu$m. Also present is at least one other selected granular detergent component. The anionic surfactant granule may be prepared by in-situ neutralisation of alkylbenzene sulphonic acid with sodium carbonate in a fluidised bed.

14 Claims, No Drawings

PARTICULATE LAUNDRY DETERGENT COMPOSITIONS CONTAINING ANIONIC SURFACTANT GRANULES

TECHNICAL FIELD

The present invention relates to particulate laundry detergent compositions containing anionic surfactants in the form of granules having a low to moderate bulk density and excellent dissolution properties. The compositions are especially suitable for use in low-temperature and/or low agitation wash processes, more particularly for washing by hand.

BACKGROUND AND PRIOR ART

Laundry detergent powders containing high levels of anionic surfactants are widely known and used for washing fabrics by hand, the high levels being desirable in order to provide effective soil removal and good foaming. However, it has been found that poor powder properties can be encountered in high-active compositions, for example, powder stickiness leading to agglomeration and poor flow. The higher the desired surfactant content, the less space is available in the formulation for inorganic ingredients, for example builders, to provide porosity and to carry the organic surfactants.

Traditionally, built detergent powder contain a base powder, prepared by spray-drying or non-tower granulation or a combination of such processes, consisting of structured particles containing all, or the major part of, the surfactant and builder in the formulation. Other ingredients that are not suitable for incorporation into the base powder, for example, bleaches, enzymes and perfume, are subsequently admixed with the base powder.

In WO 98 54289A (Unilever) published on Dec. 3, 1998, it has been disclosed that higher total surfactant levels can be achieved without sacrificing powder properties if the traditional base powder is supplemented, or replaced altogether, by separate granular components in which certain ingredients are concentrated or segregated from one another. For example, the powder may be a "modular" one composed of granules containing a high level of anionic surfactant, granules containing a high level of nonionic surfactant, and builder granules containing little or no surfactant.

The anionic surfactant granules disclosed contain from 60 to 99% by weight, preferably from 65 to 96% by weight, of anionic surfactant, for example, linear alkylbenzene sulphonate (LAS). These granules, which are also disclosed in WO 96 06916A, WO 96 06917A, WO 97 32002A and WO 97 32005A (Unilever), are preferably prepared by in-situ neutralisation of LAS acid by sodium carbonate in a flash dryer.

These granules may also be used in formulations which represent a compromise between the traditional and "modular" approaches. WO 98 54287A (Unilever) published on Dec. 3, 1998 discloses laundry detergent powders which comprise a traditional phosphate-built base powder in combination with at least 10 wt % by weight of the high-anionic surfactant granules discussed above.

The anionic surfactant granules disclosed in the earlier filed Unilever patent applications discussed above are of high bulk density, so that they are less suitable for use in lower-bulk-density powders. For handwashing, however, lower-density, more porous products are generally preferred because they dissolve more quickly and completely, which is important when the wash is carried out under conditions of relatively low temperature and low agitation.

It has now been discovered that a similar, wholly or partially "modular" approach may be adopted for powders of lower bulk density, using a different anionic surfactant (linear alkylbenzene sulphonate, LAS) granule having a lower bulk density and a somewhat lower surfactant loading, but still higher than can be obtained using a traditional base powder. This surfactant granule is prepared by a in-situ neutralisation process using a fluidised bed.

WO 94 07990A (Henkel) discloses anionic surfactant granules of high surfactant content prepared using a fluidised bed. The process may involve in-situ neutralisation, for example, primary alcohol sulphate (PAS) paste and a minor amount of LAS acid may be granulated with sodium carbonate on a fluidised bed.

Preparation of detergent base powders containing anionic surfactants (up to 31 wt %) by in-situ neutralisation on a fluidised bed is disclosed in WO 96 04359A (Unilever).

DEFINITION OF THE INVENTION

The present invention provides a particulate laundry detergent composition composed of at least two different granular components, comprising (a) a granular anionic surfactant component having a bulk density within the range of from 300 to 600 g/l comprising:
  (a1) from 40 to 55 wt % of linear alkylbenzene sulphonate (LAS),
  (a2) from 45 to 60 wt % of a particulate carrier material comprising
    (a21) from 30 to 100 wt % of sodium carbonate,
    (a22) optionally from 0 to 70 wt % of finely-divided water-insoluble particulate material,
      with the proviso that the carrier material must contain from 25 to 70 wt % of finely-divided water-insoluble particulate material (a22) if the average particle size of the sodium carbonate exceeds 40 $\mu$m, the percentages being based on the carrier material;

(b) at least one other granular detergent component selected from
  (b1) a detergent base powder composed of structured particles comprising anionic surfactant, builder, optionally nonionic surfactant and optionally other detergent ingredients,
  (b2) a builder granule,
  (b3) a granule containing at least 30 wt % of alkyl ether sulphate,
  (b4) a granule containing at least 20 wt % of nonionic surfactant.

The invention also provides a process for the preparation of the anionic surfactant granule (a) defined above, which process comprises contacting alkylbenzene sulphonic acid with at least sufficient sodium carbonate to effect neutralisation of the alkylbenzene sulphonic acid, optionally together with a finely-divided water-insoluble particulate material, in a fluidised bed whereby neutralisation and granulation are effected, the amount of alkylbenzene sulphonic acid being sufficient to provide a content of alkylbenzene sulphonate in the granular detergent component obtained thereby of from 40 to 55 wt %.

A further subject of the invention is an anionic surfactant granule (a) as defined previously, prepared by the process defined in the previous paragraph.

DETAILED DESCRIPTION OF THE INVENTION

The detergent composition of the invention is composed of at least two different granular components, one of which is a defined anionic surfactant (LAS) granule. The other may be a base powder, a builder granule, an alkyl ether sulphate granule, or a nonionic surfactant granule. Unless the other granular component is a base powder, the composition is "modular" and preferably comprises at least three different components: for example, as well as the LAS granule, a builder granule and at least one other surfactant granule.

Whether or not "modular", the composition preferably Contains from 2 to 50 wt % of the LAS granule (a) and from 50 to 98 wt % of other granular components (b), the percentages being based on the total amount of the granular components (a) and (b).

The Anionic Surfactant (LAS) Granule (a)

In the LAS granule (a), the content of LAS ranges from 40 to 55 wt %, preferably from 40 to 50 wt %. The granule has a bulk density within the range of from 300 to 600 g/litre, the 400 to 500 g/litre range being especially preferred. Powder properties and dissolution properties are excellent.

The carrier material, present in an amount of from 45 to 60 wt %, is composed principally of sodium carbonate, but in some circumstances a finely divided water-insoluble particulate material is also present. It has been found that, in order to obtain the desired surfactant loading of at least 40 wt % in combination with good powder properties, it is necessary either to use a finely-divided water-insoluble particulate material to supplement the sodium carbonate, and/or use sodium carbonate that has been milled to a smaller than normal average particle size.

If the sodium carbonate has an average particle size not exceeding 40 $\mu$m, then the presence of finely-divided water-insoluble particulate material is not necessary; but may in any case be desirable. Sodium carbonate milled to an average particle size within the range of 20 to 30 $\mu$m may suitably be used. Micronised or micropulverised sodium carbonate (typical average particle size less than 5 $\mu$m) may if desired be used but such a very small particle size is not essential. The particle size quoted here is the average weighted surface diameter or Sauter mean diameter $d_{3,2}$.

If the sodium carbonate has an average particle size of 40 $\mu$m or above, then the presence of finely-divided water-insoluble particulate material appears to be essential in order to achieve an anionic surfactant loading of 40 wt % or above. The finely-divided water-insoluble particulate material may be selected, for example, from zeolites, kaolin, calcite, silicas and silicates. The preferred material is zeolite.

The zeolite may be zeolite 4A or, preferably, zeolite MAP as described and claimed in EP 384 070B (Unilever) and commercially available as Doucil (Trade Mark) A24 from Crosfield Chemicals. Especially preferred is a carrier comprising sodium carbonate and zeolite in a weight ratio of from 70:30 to 30:70.

Preparation of the LAS Granule (a)

The LAS granule is prepared by in-situ neutralisation using a fluidised bed. The process comprises contacting an appropriate amount of LAS acid with at least sufficient sodium carbonate to effect neutralisation, optionally together with zeolite or other finely-divided water-insolunble particulate material, in a fluidised bed whereby neutralisation and granulation are effected.

In the process, the solids (sodium carbonate and, if present, zeolite or other finely-divided water-insoluble particulate material) are fluidised and the LAS acid is sprayed on at a suitable rate and with a suitable droplet size.

If desired, part of the carbonate, or part of the finely divided water-insoluble particulate material, if present, may be retained and dosed at the end of the process as layering material.

Other Granules (b)

As indicated previously, the compositions of the invention contain at least one other granule (b).

This may be a base powder, a product composed of structured particles containing both surfactant and builder, and optionally other minor ingredients suitable for incorporation into a base powder (for example, fluorescers, antiredeposition polymers such as sodium carboxymethyl cellulose). The base powder may be spray-dried, prepared by wholly non-tower granulation (also known as agglomeration), or prepared by any combination of these techniques (for example, spray-drying followed by densification).

In this case, where a base powder is present, the final composition may consist essentially of the base powder (b), the anionic surfactant granule (a), and any usual postdosed ingredients, for example, bleaches, enzymes, perfumes. Postdosed ingredients are discussed in more detail below under "Detergent ingredients".

However additional granules developed primarily for a "modular" approach may also be present if desired. Between the extremes of the "traditional" powder in which the LAS granule is present essentially to boost the surfactant carrying capacity of the base powder, and the wholly "modular" powder in which all surfactants and builders are present as separate granules, various intermediate formulations and combination granules can of course be envisaged.

Builder Granules

Builder granules may typically be based either on sodium tripolyphosphate or on zeolite, with various minor ingredients but only insignificant levels of, or no, surfactant. Builder granules may be prepared by spray-drying or non-tower routes or mixtures of the two. Builder compounds are discussed in more detail below under "Detergent ingredients".

Alkyl Ether Sulphate Granules

A preferred ingredient which can enrich the overall anionic surfactant content of the composition is an alkyl ether sulphate granule as described and claimed in our copending International patent application of even date claiming priority from British Patent Application No. 98 25558.1 filed on Nov. 20, 1998. This granule comprises at least 30 wt % of alkyl ether sulphate and a carrier material comprising a silica or silicate having a liquid carrying capacity of at least 1.0 ml/g.

Nonionic Surfactant Granules one preferred nonionic surfactant granule comprises at least 55 wt % o f nonionic surfactant and a carrier material comprising a silica or silicate having a liquid carrying capacity of at least 1.0 ml/g. These granules are described and claimed in WO 98 54281A (Unilever) published on Dec. 3, 1998.

An alternative nonionic surfactant granule, which is especially preferred on account of its excellent dissolution properties, comprises from 20 to 30 wt % of nonionic surfactant and a non-spray-dried particulate carrier material comprising s odium carbonate together with sodium bicarbonate and/or sodium sesquicarbonate, and the sodium salt of a solid water-soluble organic acid. These granules are described and claimed in our copending International patent application of even date claiming priority from British Patent Application No. 98 25560.7 filed on Nov. 20, 1998.

Detergent Ingredients

The finished detergent composition, whether containing a base powder or a number of different granules, will contain detergent ingredients as follows.

As previously indicated, the detergent compositions will contain, as essential ingredients, one or more detergent active compounds (surfactants) which may be chosen from soap and non-soap anionic, cationic, nonionic, amphoteric and zwitterionic detergent active compounds, and mixtures thereof.

Many suitable detergent active compounds are available and are fully described in the literature, for example, in "Surface-Active Agents and Detergents", Volumes I and II, by Schwartz, Perry and Berch.

The preferred detergent active compounds that can be used are soaps and synthetic non-soap anionic and nonionic compounds.

Anionic surfactants are well-known to those skilled in the art. Examples include alkylbenzene sulphonates, particularly linear alkylbenzene sulphonates having an alkyl chain length of $C_8$–$C_{15}$; primary and secondary alkylsulphates, particularly $C_8$–$C_{15}$ primary alkyl sulphates; alkyl ether sulphates; olefin sulphonates; alkyl xylene sulphonates; dialkyl sulphosuccinates; and fatty acid ester sulphonates. Sodium salts are generally preferred.

Nonionic surfactants that may be used include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

Cationic surfactants that may be used include quaternary ammonium salts of the general formula $R_1R_2R_3R_4N^+ X^-$ wherein the R groups are long or short hydrocarbyl chains, typically alkyl, hydroxyalkyl or ethoxylated alkyl groups, and X is a solubilising cation (for example, compounds in which $R_1$ is a $C_8$–$C_{22}$ alkyl group, preferably a $C_8$–$C_{10}$or $C_{12}$–$C_{14}$ alkyl group, $R_2$ is a methyl group, and $R_3$ and $R_4$, which may be the same or different, are methyl or hydroxyethyl groups); and cationic esters (for example, choline esters).

Amphoteric surfactants, for example, amine oxides, and zwitterionic surfactants, for example, betaines, may also be present.

Preferably, the quantity of anionic surfactant is in the range of from 5 to 50% by weight of the total composition.

More preferably, the quantity of anionic surfactant is in the range of from 8 to 35% by weight.

Nonionic surfactant, if present, is preferably used in an amount within the range of from 1 to 20% by weight.

The total amount of surfactant present is preferably within the range of from 5 to 60 wt %.

The total amount of alkyl ether sulphate or other heat-sensitive surfactant present may suitably range from 1 to 20 wt %, preferably from 1.5 to 15 wt % and more preferably from 2 to 10 wt %.

The compositions may suitably contain from 10 to 80%, preferably from 15 to 70% by weight, of detergency builder. Preferably, the quantity of builder is in the range of from 15 to 50% by weight.

The detergent compositions may contain as builder a crystalline aluminosilicate, preferably an alkali metal aluminosilicate, more preferably a sodium aluminosilicate (zeolite).

The zeolite used as a builder may be the commercially available zeolite A (zeolite 4A) now widely used in laundry detergent powders. Alternatively, the zeolite may be maximum aluminium zeolite P (zeolite MAP) as described and claimed in EP 384 070B (Unilever), and commercially available as Doucil (Trade Mark) A24 from Crosfield Chemicals Ltd, UK. Zeolite MAP is defined as an alkali metal aluminosilicate of zeolite P type having a silicon to aluminium ratio not exceeding 1.33, preferably within the range of from 0.90 to 1.33, preferably within the range of from 0.90 to 1.20.

Especially preferred is zeolite MAP having a silicon to aluminium ratio not exceeding 1.07, more preferably about 1.00. The particle size of the zeolite is not critical. Zeolite A or zeolite MAP of any suitable particle size may be used.

Also preferred according to the present invention are phosphate builders, especially sodium tripolyphosphate. This may be used in combination with sodium orthophosphate, and/or sodium pyrophosphate.

Other inorganic builders that may be present additionally or alternatively include sodium carbonate, layered silicate, amorphous aluminosilicates.

Organic builders that may be present include polycarboxylate polymers such as polyacrylates and acrylic/maleic copolymers; polyaspartates; monomeric polycarboxylates such as citrates, gluconates, oxydisuccinates, glycerol mono-di-and trisuccinates, carboxymethyloxysuccinates, carboxy-methyloxymalonates, dipicolinates, hydroxyethyliminodiacetates, alkyl- and alkenylmalonates and succinates; and sulphonated fatty acid salts.

Organic builders may be used in minor amounts as supplements to inorganic builders such as phosphates and zeolites. Especially preferred supplementary organic builders are citrates, suitably used in amounts of from 5 to 30 wt %, preferably from 10 to 25 wt %; and acrylic polymers, more especially acrylic/maleic copolymers, suitably used in amounts of from 0.5 to 15 wt %, preferably from 1 to 10 wt %.

Builders, both inorganic and organic, are preferably present in alkali metal salt, especially sodium salt, form.

Builders are normally wholly or predominantly included in the granular components, either in the base powder or in a separate builder granule.

Detergent compositions according to the invention may also suitably contain a bleach system. It is preferred that the compositions of the invention contain peroxy bleach compounds capable of yielding hydrogen peroxide in aqueous solution, for example inorganic or organic peroxyacids, and inorganic persalts such as the alkali metal perborates, percarbonates, perphosphates, persilicates and persulphates. Bleach ingredients are generally post-dosed as powders.

The peroxy bleach compound, for example sodium percarbonate, is suitably present in an amount of from 5 to 35 wt %, preferably from 10 to 25 wt %. The peroxy bleach compound, for example sodium percarbonate, may be used in conjunction with a bleach activator (bleach precursor) to improve bleaching action at low wash temperatures. The bleach precursor is suitably present in an amount of from 1 to 8 wt %, preferably from 2 to 5 wt %.

Preferred bleach precursors are peroxycarboxylic acid precursors, more especially peracetic acid precursors and peroxybenzoic acid precursors; and peroxycarbonic acid precursors. An especially preferred bleach precursor suitable for use in the present invention is N, N, N', N'-tetracetyl ethylenediamine (TAED).

A bleach stabiliser (heavy metal sequestrant) may also be present. Suitable bleach stabilisers include ethylenediamine tetraacetate (EDTA), ethylenediamine disuccinate (EDDS), and the aminopolyphosphonates such as ethylenediamine tetramethylene phosphonate (EDTMP) and diethylenetriamine pentamethylene phosphonate (DETPMP).

The detergent compositions may also contain one or more enzymes. Suitable enzymes include the proteases, amylases, cellulases, oxidases, peroxidases and lipases usable for incorporation in detergent compositions.

Preferred proteolytic enzymes (proteases) are catalytically active protein materials which degrade or alter protein types of stains when present as in fabric stains in a hydrolysis reaction. They may be of any suitable origin, such as vegetable, animal, bacterial or yeast origin.

Proteolytic enzymes or proteases of various qualities and origins and having activity in various pH ranges of from 4–12 are available. Proteases of both high and low isoelectric point are suitable.

Other enzymes that may suitably be present include lipases, amylases, and cellulases including high-activity cellulases such as "Carezyme").

Detergency enzymes are commonly employed in granular form in amounts of from about 0.1 to about 3.0 wt %. However, any suitable physical form of enzyme may be used.

Antiredeposition agents, for example cellulose esters and ethers, for example sodium carboxymethyl cellulose, may also be present.

The compositions may also contain soil release polymers, for example sulphonated and unsulphonated PET/POET polymers, both end-capped and non-end-capped, and polyethylene glycol/polyvinyl alcohol graft copolymers such as Sokalan (Trade Mark) HP22. Especially preferred soil release polymers are the sulphonated non-end-capped polyesters described and claimed in WO 95 32997A (Rhodia Chimie).

The compositions of the invention may also contain dye transfer inhibiting polymers, for example, polyvinyl pyrrolidone (PVP), vinyl pyrrolidone copolymers such as PVP/PVI, polyamine-N-oxides, PVP-NO etc.

The detergent composition may contain water-soluble alkali metal silicate, preferably sodium silicate having a $SiO_2$:$Na_2O$ mole ratio within the range of from 1.6:1 to 4:1.

Other materials that may be present in detergent compositions of the invention include fluorescers; photobleaches; inorganic salts such as sodium sulphate; foam control agents or foam boosters as appropriate; dyes; coloured speckles; perfumes; and fabric conditioning compounds.

Ingredients which are normally but not exclusively postdosed, may include bleach ingredients, bleach precursor, bleach catalyst, bleach stabiliser, photobleaches, alkali metal carbonate, water-soluble crystalline or amorphous alkaline metal silicate, layered silicates, antiredeposition agents, soil release polymers, dye transfer inhibitors, fluorescers, inorganic salts, foam control agents, foam boosters, proteolytic, lipolytic, amylitic and cellulytic enzymes, dyes, speckles, perfume, fabric conditioning compounds and mixtures thereof.

EXAMPLES

The present invention will be further illustrated by the following non-limiting Examples.

Except where stated otherwise, all quantities are in parts or percentages by weight.

In the following examples, the following test methods will be used:

Dynamic Flow Rate (DFR)

The dynamic flow-rate or DFR is measured by the following method. The apparatus used consists of a cylindrical glass tube having an internal diameter of 35 mm and a length of 600 mm. The tube is securely champed in a position such that its longitudinal axis is vertical. Its lower end is terminated by means of a smooth cone of polyvinyl chloride having an internal angle of 15° and a lower outlet orifice of diameter 22.5 mm. A first beam sensor is positioned 150 mm above the outlet, and a second beam sensor is positioned 250 mm above the first sensor.

To determine the dynamic flow-rate of a powder sample, the outlet orifice is temporarily closed, for example, by covering with a piece of card, and powder is poured through a funnel into the top of the cylinder until the powder level is about 10 cm higher than the upper sensor; a spacer between the funnel and the tube ensures that filling is uniform. The outlet is then opened and the time t (seconds) taken for the powder level to fall from the upper sensor to the lower sensor is measured electronically. The measurement is normally repeated two or three times and an average value taken. If V is the volume (ml) of the tube between the upper and lower sensors, the dynamic flow rate DFR (ml/s) is given by the following equation:

$$DFR=V/t$$

The averaging and calculation are carried out electronically and a direct read-out of the DFR value obtained.

Solubility Measurement 5 g of the powder under investigation is dosed into 500 ml of water contained in 1000 ml beaker at a temperature of 20° C. The water is stirred with a magnetic stirring rod of 6 cm maintaining a 4 cm vortex for 2 minutes after which the solution is poured over a filter with a mesh size of 125 μm. The filter with residue is dried at 80° C. in an oven for an hour after which the amount of residue is weighed. The amount of insolubles is calculated by:

$$\text{Insolubles [\%]} = \frac{\text{Amount of residue [g]}}{\text{Amount of initial powder [g]}} \times 100\%$$

Rate of Dissolution

A 1.25 g sample of the granules is dissolved in 500 ml of water with stirring, and the conductivity of the solution as a function of time is recorded. The test is continued until the conductivity has reached a constant value. The measure for the rate of dissolution is taken to be $t_{90}$, the time (in seconds) taken to reach 90% of the final conductivity value.

EXAMPLES

Examples A1 to A6, Comparative Examples AX to AZ

LAS Granules Prepared on Fluidised Bed

In a Vometec (Trade Mark) batch fluid bed 10 kg of solids (carbonate and, if applicable, zeolite MAP) were dosed. This bed was fluidised and LAS acid at 70° C. was sprayed on with a spray-on velocity of 400 g/min.

Comparative Example AX was produced by using standard sodium carbonate (light ash ex Akzo, having a $d_{3,2}$ value of 47.5 μm)

Example A1 was made with milled carbonate, which had a $d_{3,2}$ value of 24.2 μm.

Comparative Example AY was made using standard carbonate. In this case part of the carbonate was retained and dosed at the end as layering material; however it was still not possible to achieve a 40 wt % surfactant loading.

Comparative Example AZ was made, also using standard carbonate, by first spraying on 3.2 kg of LAS, then closing the LAS supply for 4.5 hours while leaving the powder to age. Subsequently the LAS supply was opened again and additional 1.2 kg LAS acid was sprayed on. Again it was not possible to achieve a 40 wt % surfactant loading.

Example A2 was prepared by starting with a 1:1 mixture of standard sodium carbonate and zeolite MAP.

Example A3 was made by the same procedure as Example A2 but spraying on less LAS acid.

Example A4 was made by the same procedure but spraying on a higher amount of LAS acid.

Example A5 was produced in the same way as Comparative Example AX, but in this case milled carbonate as described for Example A1 was used in combination with zeolite MAP (1:1 ratio at the start of the experiment).

Example A6 was made by the same procedure as Example A5, but spraying on more LAS acid.

The granules had properties as shown in the table.

| Example | NaLAS [%] | Bulk density [g/1] | Dynamic flow rate [ml/s] | RRd [μm] | $t_{90}$ [s] |
|---|---|---|---|---|---|
| AZ | 30.5 | 511 | 139 | 689 | 62 |
| A1 | 40.2 | 482 | 145 | 549 | 64 |
| AX | 35.0 | 472 | 145 | 917 | 84 |
| AY | 36.3 | 495 | 151 | 572 | 61 |
| A2 | 42.9 | 447 | 147 | 571 | 34 |
| A3 | 40.2 | 400 | 126 | 588 | 28 |
| A4 | 43.7 | 448 | 137 | 647 | 39 |
| A5 | 41.3 | 429 | 126 | 471 | 23 |
| A6 | 46.7 | 452 | 137 | 620 | 34 |

As can be seen the $t_{90}$ value (time to dissolve 90% of the granules) was in most cases less than 60 S.

Example A7

LAS Granule

LAS granule A7 was prepared in the Vometec fluid bed using the procedure as described earlier. The raw materials used, and the properties were as follows:

| A7 | wt % |
|---|---|
| LAS acid | 40.7 |
| sodium carbonate | 28.2 |
| Zeolite MAP | 31.1 |
| Resulting NaLAS level [wt %] | 43.5 |
| Bulk density (g/l] | 435 |
| Dynamic flow rate [ml/s] | 141 |

Examples P1 to P6

Detergent Compositions

The following base powders and granules were prepared.

Base powder F1: Spray-dried Phosphate Base

A slurry was prepared by mixing water, NaOH solution, linear alkylbenzene sulphonic acid (LAS acid), sodium tripolyphosphate (STP), sodium sulphate and sodium alkaline silicate. The slurry was spray-dried in a spray-drying tower at a rate of 1100 kg/h using an outlet air temperature of approximately 115–120° C. The resulting powder was cooled and collected. Powder F1 had the following formulation:

| Base powder F1 | wt % |
|---|---|
| STP | 28.3 |
| NaLAS | 27.8 |
| Sodium silicate | 11.0 |
| Sodium sulphate | 21.0 |
| Moisture, minors etc | 11.8 |

Base powder F2: Non-tower Phosphate Base

This powder was prepared by dosing STP, sodium carbonate and LAS acid into a Fukae FS30 granulator. The solids were pre-mixed after which the LAS acid was added and the powder was granulated using an impeller speed of 100 rpm and a chopper speed of 3000 rpm until satisfactory granules were formed. At the end of the process the granules were layered with zeolite 4A. The following formulation was formed by this process:

| Base powder F2 | wt % |
|---|---|
| STP | 45.2 |
| Zeolite (anhydr) | 2.4 |
| NaLAS | 26.7 |
| Sodium carbonate | 18.2 |
| Moisture, minors etc | 7.5 |

Builder granule B1: Non-tower Posphate Granule

Builder granule B1 was produced by granulating STP and acrylate/maleate copolymer (Sokalan (Trade Mark) CP5 ex BASF) solution in a fluidised bed. The STP was fluidised, while at the same time a 10% solution of Sokalan CP5 was added at a rate of 400 g/min. In this way a free flowing builder granule was formed with the following composition.

| Builder granule B1 | wt % |
|---|---|
| STP | 68.2 |
| Acrylate/maleate copolymer | 4.3 |
| Moisture, etc | 27.5 |

Builder granule B2: Non-tower Zeolite/citrate/polymer Granule

This was produced by continuously dosing zeolite MAP (Doucil A24 ex Crosfield), granular trisodium citrate and 40% acrylate/maleate copolymer (Sokalan CP5 ex BASF) solution into a Lödige CB30 recycler. The CB30 was operated at 1500 rpm. The exiting powder was led through a Lödige KM300 ploughshare (120 rpm), in which densification took place. The resulting powder was dried in a fluid bed. The composition of the resulting builder granule was:

| Ingredients [wt %] | B2 |
|---|---|
| Zeolite MAP (anh) | 41.6 |
| Trisodium citrate | 31.3 |
| Acrylate/maleate copolymer | 12.2 |
| Water etc. | 14.9 |

Nonionic Surfactant Granule N1: Nonionic Surfactant on Insoluble Porous (silica) Carrier These granules were produced using a Lödige CB30 recycler, followed by a Niro fluid bed and a Mogensen sieve. The Lödige CB30 was operated at 1500 rpm. Water was used to cool the CB30 jacket during the process. The air flow in the Niro fluid bed was 900–1000 $m^3$/hr. The total flow of powder exiting the process was in the order of 600 kg/h. Silica (Sorbosil (Trade Mark) TC15 was continuously dosed into the CB30, into which also a nonionic surfactant ($C_{12-15}$ alcohol with average degree of ethoxylation of 7, Synperonic (Trade Mark) A7 ex ICI) was dosed via dosing pipes. At the same time a 40% glucose solution was was dosed. This set of solid and liquid materials was mixed and granulated in the CB30 after which the resulting powder was entered in the fluid bed and treated with air which had a temperature of 80–120° C. Fines were filtered from the air stream with a cyclone and filter bags. Coarse particles (>1400 μm) were separated from the product by the Mogensen sieve.

The resulting granules had the formulations and properties shown in the table below.

| Composition [wt %] | N1 |
|---|---|
| Silica (Sorbosil TC15) | 27.7 |
| $C_{12}$–$C_{15}$ nonionic surfactant 7EO | 58 |
| Glucose | 10.8 |
| Water | 3.5 |

Nonionic Surfactant Granule N2: Nonionic Surfactant on Water-soluble (sodium sesquicarbonate) Carrier These granules were produced as follows. In a 50-litre L ödige ploughshare mixer the following ingredients were dosed in the following proportions (weight %):

| | wt % |
|---|---|
| Sodium carbonate | 56.0 |
| Citric acid | 9.8 |
| $C_{12-15}$ nonionic surfactant 7EO: Lutensol (Trade Mark) AO7 ex BASF | 22.6 |
| Water | 11.3 |

The sodium carbonate and citric acid were mixed together after which the nonionic surfactant was added. After the nonionic surfactant had been distributed well, water was added, followed by approximately 5 minutes of granulation. During the process a considerable temperature rise was observed. The resulting product was cooled.

Detergent Compositions

The following full formulations were assembled, using LAS granule A7 and the various other base powders or granules, together with standard postdosed materials.

| Ingredients [wt %] | P1 | P2 |
|---|---|---|
| A7 | 22.5 | 34.4 |
| F1 | 51.2 | |
| Granular sodium carbonate | 12.6 | 17.5 |
| Granular sodium sulphate | 12.6 | 45.1 |
| STP | | 2.5 |
| Enzymes, perfume etc. | 1.1 | 0.5 |
| Bulk density [g/l] | 454 | 782 |
| Dynamic flow rate [ml/s] | 118 | 137 |

Further formulations in accordance with the present invention are shown in the following table.

The asterisked ingredients were as follows:

| Formulation [wt %] | P3 | P4 | P5 | P6 |
|---|---|---|---|---|
| A7 | 13.5 | 13.5 | 28.70 | 20.00 |
| F2 | | | 65.77 | |
| B1 | 32.7 | 32.7 | | |
| B2 | | | | 29.63 |
| N1 | 12.3 | | | 12.6 |
| N2 | | 29.6 | | |

-continued

| Formulation [wt %] | P3 | P4 | P5 | P6 |
|---|---|---|---|---|
| Dense sodium carbonate | 9.15 | 0.97 | 3.96 | |
| Sodium sulphate | 9.12 | | | |
| Sodium perborate tetrahydrate | 18.0 | 18.0 | | |
| Sodium percarbonate | | | | 19.0 |
| TAED | 2.0 | 2..0 | | 5.5 |
| Antifoam granules | 0.8 | 0.8 | | 1.7 |
| Sodium carboxymethyl cellulose (80%) | 0.26 | 0.26 | | 0.54 |
| Fluorescer granules (15%) | 0.53 | 0.53 | | 1.3 |
| Soil release polymer granules* | 0.21 | 0.21 | | 1.5 |
| Polyvinyl pyrrolidone granules | 0.1 | 0.1 | | 0.4 |
| Carbonate/silicate granules** | | | | 5.5 |
| EDTMP*** | 0.5 | 0.5 | 0.46 | 1 |
| Blue speckles | | | 0.2 | |
| Green speckles | | | 0.2 | |
| Protease (Savinase) | 0.36 | 0.36 | | 0.78 |
| Protease (Purafect 2100G) | | | 0.31 | |
| Amylase (Termamyl) | 0.25 | 0.25 | | |
| Lipolase | 0.025 | 0.025 | 0.1 | 0.12 |
| Perfume | 0.19 | 0.19 | 0.4 | 0.45 |

*Sokalan (Trade Mark) HP23 ex BASF
**Nabion (Trade Mark) 15 ex Rhodia
***Dequest (Trade Mark) 2047 ex Monsanto Examples A8, A9 and A10

LAS Granules

LAS granule A8 was prepared by mixing 5 kg of zeolite MAP and 5 kg of sodium carbonate in a Vometec fluid bed. To this mixture 7.2 kg of LAS acid was dosed at a rate of 400 ml/min. After all LAS acid had been added the powder was layered using 0.5 kg of zeolite MAP.

The resulting granule had the following formulation:

| A8 | wt % |
|---|---|
| NaLAS | 43.6 |
| Sodium carbonate | 21.9 |
| Zeolite MAP | 31.5 |
| Water, etc. | 3.0 |

LAS granule A9 had the same composition, but was made by first mixing 5 kg of zeolite MAP and 1.5 kg of LAS acid in a 50 litre Lödige ploughshare for 60 seconds. The resulting mixture was subsequently dosed into the Vometec fluid bed at which point 5 kg of sodium carbonate was added. The remainder of the LAS acid (5.7 kg) was added to the fluidised bed at a rate of 400 ml/min. The resulting powder was layered with 0.5 kg of zeolite MAP.

Granule A10 was made in the same way as granule A8. However in this case micronised sodium carbonate with an average particle size of 2 μm was used.

The properties of granules A8, A9 and A10 are shown in the table below.

| | NaLAS [wt %] (analytically determined) | Bulk density [g/l] | Dynamic flow rate [ml/s] | RRd [μm] |
|---|---|---|---|---|
| A8 | 44.6 | 429 | 140 | 684 |
| A9 | 42.1 | 462 | 140 | 578 |
| A10 | 47.9 | 412 | 133 | 973 |

We claim:

1. A particulate laundry detergent composition composed of at least two different granular components, comprising (a) a granular anionic surfactant component having a bulk density within the range of from 300 to 600 g/l comprising:

(a1) from 40 to 55 wt % of linear alkylbenzene sulphonate, (a2) from 45 to 60 wt % of a particulate carrier material comprising (a21) from 30 to 100 wt % of sodium carbonate, (a22) optionally from 0 to 70 wt % of finely-divided water-insoluble particulate material, with the proviso that the carrier material must contain from 25 to 70 wt % of finely-divided water-insoluble particulate material (a22) if the average particle size of the sodium carbonate exceeds 40 μm, the percentages being based on the carrier material;

(b) at least one other granular detergent component selected from the group consisting of:

(b1) a detergent base powder composed of structured particles comprising anionic surfactant, builder, optionally nonionic surfactant and optionally other detergent ingredients, (b2) a builder granule, (b3) a granule containing at least 30 wt % of alkyl ether sulphate, (b4) a granule containing at least 20 wt % of nonionic surfactant.

2. A detergent composition as claimed in claim 1, comprising from 2 to 50% by weight of the granular anionic surfactant component (a) and from 50 to 98% by weight of one or more other granular components (b), the percentages being based on the total amount of granular components (a) and (b).

3. A detergent composition as claimed in claim 1, which is composed of at least three different granular components.

4. A detergent composition as claimed in claim 1, wherein the granular anionic surfactant component (a) contains from 40 to 50 wt % of linear alkylbenzene sulphonate.

5. A detergent composition as claimed in claim 1, wherein the granular anionic surfactant component (a) has a bulk density within the range of from 400 to 500 g/litre.

6. A detergent composition as claimed in claim 1, wherein the finely-divided water-insoluble particulate material (a22) is zeolite.

7. A detergent composition as claimed in claim 6, wherein in the granular anionic surfactant component (a) the carrier material (a2) comprises sodium carbonate and zeolite in a weight ratio of from 70:30 to 30:70.

8. A detergent composition as claimed in claim 1, wherein in the granular anionic surfactant component (a) the sodium carbonate of the carrier material (a2) has an average particle size not exceeding 40 μm.

9. A detergent composition as claimed in claim 1, which comprises a nonionic surfactant granule (b4) comprising at least 55 wt % of nonionic surfactant and a carrier material comprising a silica or silicate having a liquid carrying capacity of at least 1.0 ml/g.

10. A detergent composition as claimed in claim 1, which comprises a nonionic surfactant granule (b4) comprising from 20 to 30 wt % of nonionic surfactant and a non-spray-dried particulate carrier material comprising sodium carbonate together with sodium bicarbonate and/or sodium sesquicarbonate, and the sodium salt of a solid water-soluble organic acid.

11. A process for the preparation of a granular anionic surfactant component having a bulk density within the range of from 300 to 600 g/l and comprising:

(a1) from 40 to 55 wt % of linear alkylbenzene sulphonate, (a2) from 50 to 65 wt % of a particulate carrier material comprising (a21) from 30 to 100 wt % of sodium carbonate, (a22) optionally from 0 to 70 wt % of finely-divided water-insoluble particulate material, with the proviso that the carrier material must contain from 25 to 70 wt % of finely-divided water-insoluble particulate material (a22) if the average particle size of the sodium carbonate exceeds 40 μm, the percentages being based on the carrier material;

which process comprises contacting alkylbenzene sulphonic acid with at least sufficient sodium carbonate to effect neutralisation of the alkylbenzene sulphonic acid, optionally together with finely-divided water-insoluble particulate material, in a fluidised bed whereby neutralisation and granulation are effected, the amount of alkylbenzene sulphonic acid being sufficient to provide a content of alkylbenzene sulphonate in the granular detergent component obtained thereby of from 40 to 55 wt %.

12. A process as claimed in claim 11, wherein the finely-divided water-insoluble particulate material (a22) comprises zeolite.

13. A granular anionic surfactant component having a bulk density within the range of from 300 to 600 g/l and comprising:

(a1) from 40 to 55 wt % of linear alkylbenzene sulphonate, (a2) from 45 to 60 wt % of a particulate carrier material comprising (a21) from 30 to 100 wt % of sodium carbonate, (a22) optionally from 0 to 70 wt % of finely-divided water-insoluble particulate material, with the proviso that the carrier material must contain from 25 to 70 wt % of finely-divided water-insoluble particulate material (a22) if the average particle size of the sodium carbonate exceeds 40 μm, the percentages being based on the carrier material;

prepared by a process as claimed in claim 11.

14. A granular component as claimed in claim 13, wherein the finely-divided water-insoluble particulate material (a22) comprises zeolite.

* * * * *